US010736429B2

(12) United States Patent
Kang

(10) Patent No.: US 10,736,429 B2
(45) Date of Patent: Aug. 11, 2020

(54) EASILY ACCESSIBLE DRAWER ON A CHAIR

(71) Applicant: Beangsuk Kang, Jinhae-gu (KR)

(72) Inventor: Beangsuk Kang, Jinhae-gu (KR)

( * ) Notice: Subject to any disclaimer, the term of this patent is extended or adjusted under 35 U.S.C. 154(b) by 63 days.

(21) Appl. No.: 16/012,378

(22) Filed: Jun. 19, 2018

(65) Prior Publication Data

US 2019/0380499 A1 Dec. 19, 2019

(51) Int. Cl.

| | |
|---|---|
| ***A47C 7/62*** | (2006.01) |
| ***A61G 5/14*** | (2006.01) |
| ***E05B 65/46*** | (2017.01) |
| ***A47B 88/919*** | (2017.01) |
| ***A47B 88/90*** | (2017.01) |

(52) U.S. Cl.

CPC ..... *A47C 7/624* (2018.08); *A61G 5/14* (2013.01); *E05B 65/46* (2013.01); *A47B 88/919* (2017.01); *A47B 2088/901* (2017.01)

(58) Field of Classification Search

CPC ..... A47C 7/624; A47B 2088/901
USPC ..... 297/188.14–188.17, 188.19
See application file for complete search history.

(56) References Cited

U.S. PATENT DOCUMENTS 1,641,249 A * 9/1927 Blumental ..... A47C 7/70 312/204
1,907,322 A * 5/1933 Keicher ..... A47C 7/70 297/145
2,494,838 A * 1/1950 Slaughter ..... A47C 7/70 297/145
2,566,201 A * 8/1951 Himes ..... A47C 7/68 312/235.6
4,136,907 A * 1/1979 Hermanns ..... A47C 1/06 297/182
4,417,764 A * 11/1983 Marcus ..... B60N 2/793 297/188.17
4,792,183 A * 12/1988 Townsend, III ..... B60N 3/004 108/27
4,971,390 A * 11/1990 McGinley ..... A47C 1/143 297/188.11
5,106,153 A * 4/1992 Durling ..... A47C 7/68 297/135
5,207,477 A * 5/1993 Maxwell ..... A61G 5/10 297/188.18
5,306,071 A * 4/1994 Zamo' ..... A47C 7/62 248/311.2
5,372,403 A * 12/1994 Puerto ..... A47C 1/03 297/145

(Continued)

*Primary Examiner* — David R Dunn
*Assistant Examiner* — Tania Abraham
(74) *Attorney, Agent, or Firm* — Karthik Murthy; Murthy Patent Law PLLC

(57) ABSTRACT

The present invention is a drawer that is easily accessible on a chair by a disabled person or elderly person who has difficulty with standing or sitting. The drawer is on the side of the chair. The drawer can be reached while the person is sitting. There is a cover over the drawer, and the cover opens sideways.

The present invention can be applied to multi-use sofas with armrests on both sides.

The present invention can utilize electronic locking on one or both sides of the drawer near the top of the drawer. The present invention can also utilize biometric fingerprints as a means of locking.

The present invention allows access to the drawer using only one's arms, so no standing up is necessary.

1 Claim, 7 Drawing Sheets

(56) References Cited

U.S. PATENT DOCUMENTS

| | | | | | |
|---|---|---|---|---|---|
| 5,628,544 | A * | 5/1997 | Goodman | A47C 1/14 | 190/8 |
| 5,845,965 | A * | 12/1998 | Heath | B60N 2/77 | 297/188.19 |
| 6,042,180 | A * | 3/2000 | Lombardi | A01K 97/22 | 248/538 |
| 6,279,977 | B1 * | 8/2001 | Chen | B60R 11/0252 | 296/24.34 |
| 6,523,894 | B1 * | 2/2003 | Mellace | A47C 1/14 | 297/16.1 |
| 7,431,392 | B2 * | 10/2008 | Tamara | A47C 7/72 | 297/217.4 |
| 7,641,279 | B1 * | 1/2010 | Curcio | A47C 1/14 | 297/188.18 |
| 7,798,072 | B2 * | 9/2010 | Becker | B60N 3/002 | 108/42 |
| 8,087,722 | B2 * | 1/2012 | Hung | A47C 7/543 | 297/188.01 |
| 2009/0152915 | A1 * | 6/2009 | Krasna | A47C 1/0342 | 297/217.3 |
| 2013/0249256 | A1 * | 9/2013 | Payne, Jr. | A47C 7/50 | 297/161 |
| 2015/0008708 | A1 * | 1/2015 | Erhel | B64D 11/0646 | 297/188.19 |
| 2017/0139413 | A1 * | 5/2017 | James | G05D 1/0088 | |

* cited by examiner

EASILY ACCESSIBLE DRAWER ON A CHAIR

BACKGROUND

Currently it is difficult for a disabled or elderly person to access a drawer while sitting. Regarding side tables next to sofas, it is necessary to stand up to use the drawer.

The disabled or elderly can need many things after they sit down in chairs, and they cannot easily access them.

SUMMARY OF INVENTION

The present invention is a drawer that is easily accessible on a chair by a disabled person or elderly person who has difficulty with standing or sitting. The drawer is on the side of the chair. The drawer can be reached while the person is sitting. There is a cover over the drawer, and the cover opens sideways. In an alternative embodiment, the drawer slides forward.

The present invention can be applied to multi-use sofas with armrests on both sides.

The present invention can utilize electronic locking on one or both sides of the drawer near the top of the drawer. The present invention can also utilize biometric fingerprints as a means of locking.

The present invention allows access to the drawer using only one's arms, so no standing up is necessary.

DETAILED DESCRIPTION

The present invention is a drawer that is easily accessible on a chair by a disabled person or elderly person who has difficulty with standing or sitting. The drawer is on the side of the chair. The drawer can be reached while the person is sitting. There is a cover over the drawer, and the cover opens sideways. In an alternative embodiment, the drawer slides forward.

The present invention allows access to the drawer using only one's arms, so no standing up is necessary.

The present invention can be applied to multi-use sofas with armrests on both sides.

The present invention can utilize electronic locking on one or both sides of the drawer near the top of the drawer. The present invention can also utilize biometric fingerprints as a means of locking.

The present invention can be of any size that fits within the side area of a chair.

The drawer is not built into the seat, and there is no drawer at the bottom of the seat.

The drawer does not interfere with any leg-raising device built into the chair.

In one embodiment of the present invention, the drawer may be motorized so that it moves automatically once opened.

In one embodiment of the present invention, in a one-person sofa, there may be drawers located on both armrests of the chair.

In one embodiment of the present invention, on one side of the chair is a normal drawer, and on the other side is a drawer with a cover. The drawer with a cover goes completely outward and moves upwards to the top of the armrest and attaches to the sides as high as the armrest.

In one embodiment of the present invention, on the top of the armrest of the chair is a storage box with a folding cover.

The cover of the drawer opens sideways. In an alternative embodiment, the drawer slides forward.

The user can put anything the user removed from the drawer on the open cover.

Figure 1:
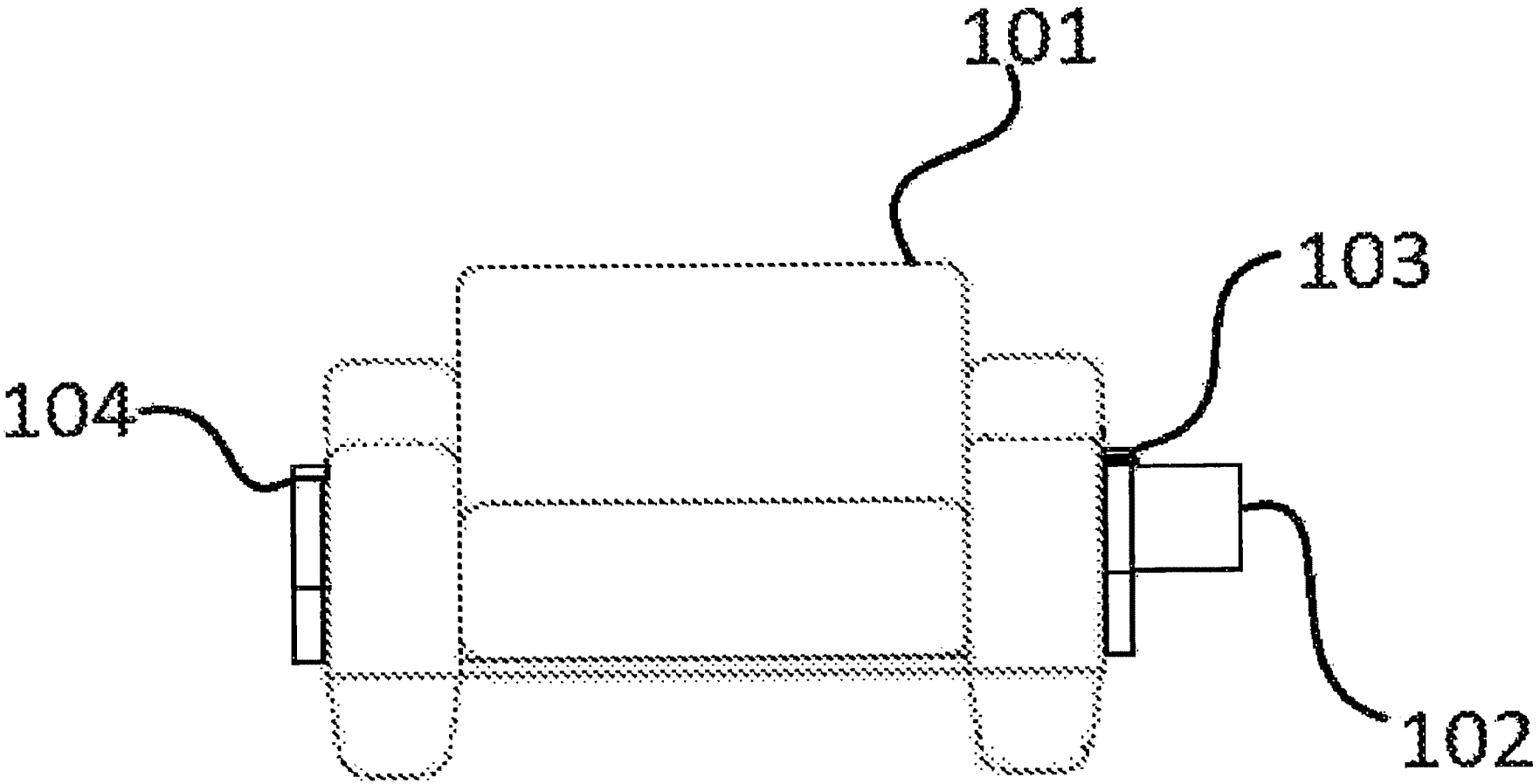
FIG. 1 illustrates a system including one embodiment of the present invention.

FIG. 1 depicts a chair with one embodiment of the present invention. It includes a chair 101, a cover of the drawer 102, an area where the locking mechanism is located 103, and another drawer 104 on the other side of the chair.

Figure 2:
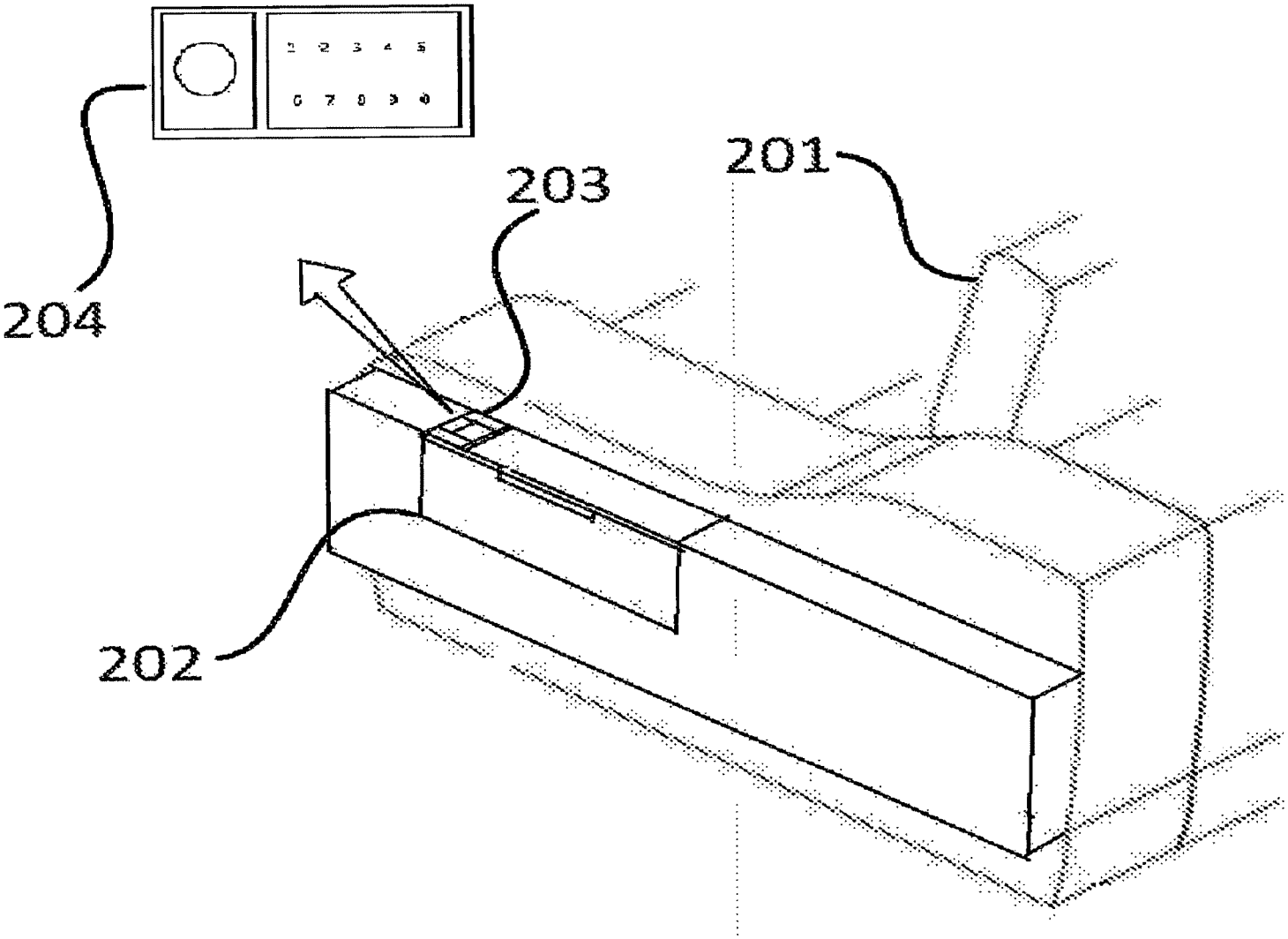
FIG. 2 illustrates a system including one embodiment of the present invention.

FIG. 2 depicts an oblique view of the left part of the chair with an embodiment of the present invention. It includes a chair 201, a drawer 202 on the left side of the armrest of the chair, and a locking mechanism 203 on the top side of the drawer. It also displays what the locking mechanism would look like, in terms of a numerical panel 204.

Figure 3:
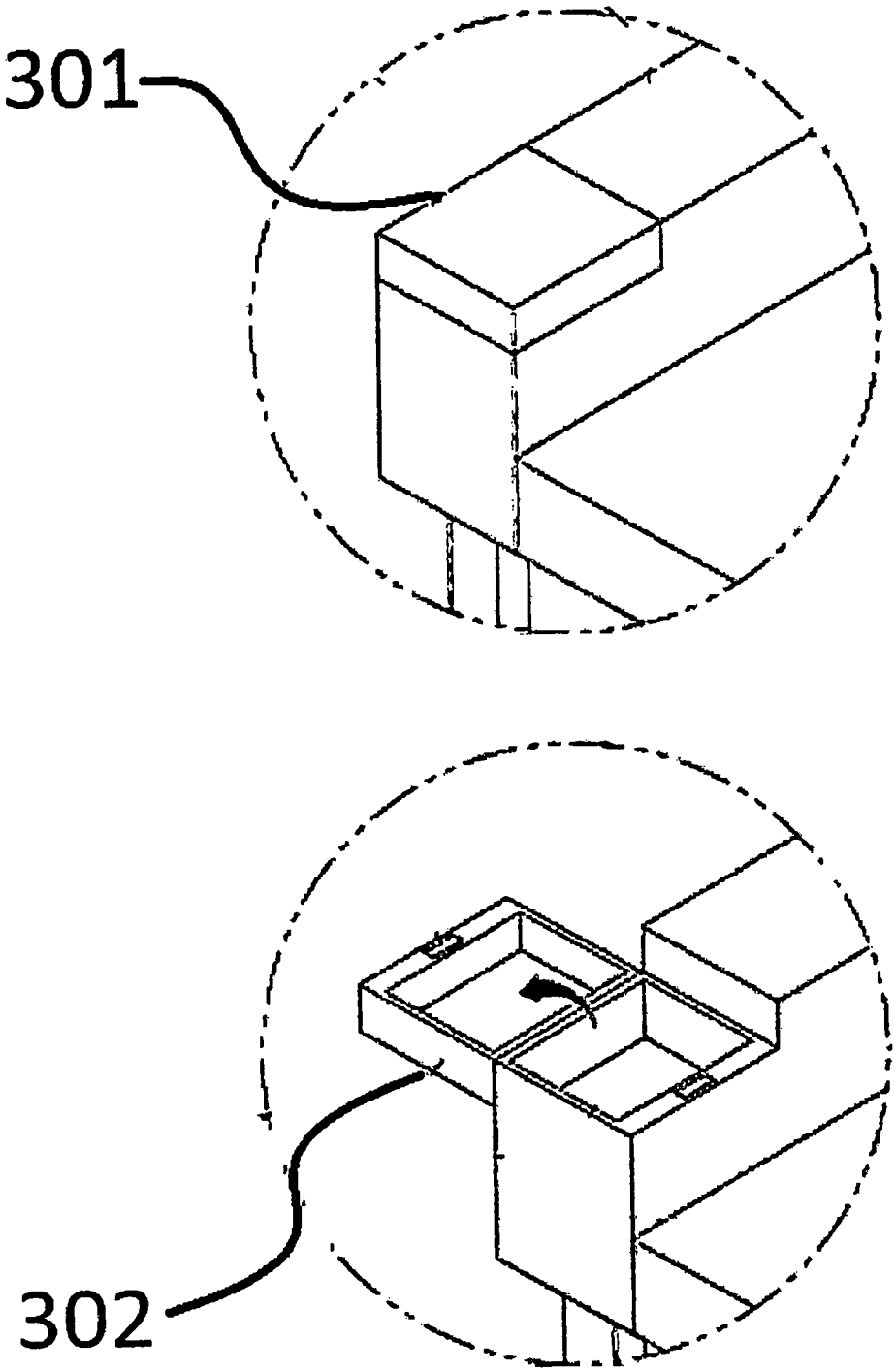
FIG. 3 illustrates a system including one embodiment of the present invention.

FIG. 3 depicts an oblique view of the part of the chair with an embodiment of the present invention. It includes a storage box 301, and the motion and direction of 1 way that the drawer could be opened, wherein the top 302 of the storage box 301 is rotated vertically 180 degrees, and hangs off the chair, allowing the inside of the storage box 301 to be accessible.

Figure 4:
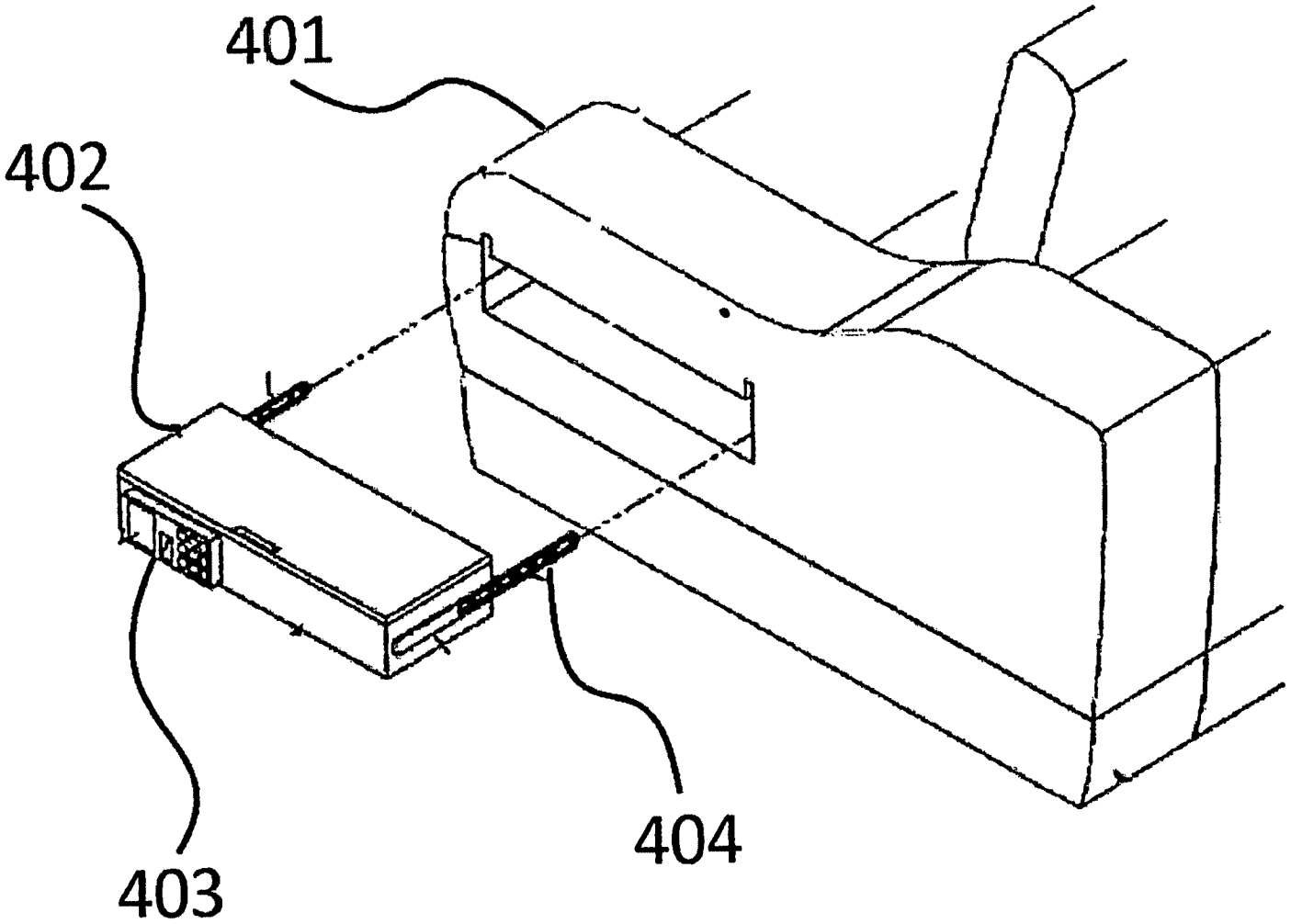
FIG. 4 illustrates a system including one embodiment of the present invention.

FIG. 4 depicts an oblique view of the left part of the chair with an embodiment of the present invention. It includes a chair 401, and a drawer 402 on the left side of the armrest of the chair, wherein the drawer is shown as it would be if it were removed from the chair. In this embodiment, the locking mechanism 403 is on the left side of the drawer. Additionally, the sliding mechanism 404 by which the drawer comes out of the chair is displayed. Furthermore, the drawer is movable upwards to a top of the armrest and attaches as high as the armrest.

Figure 5:
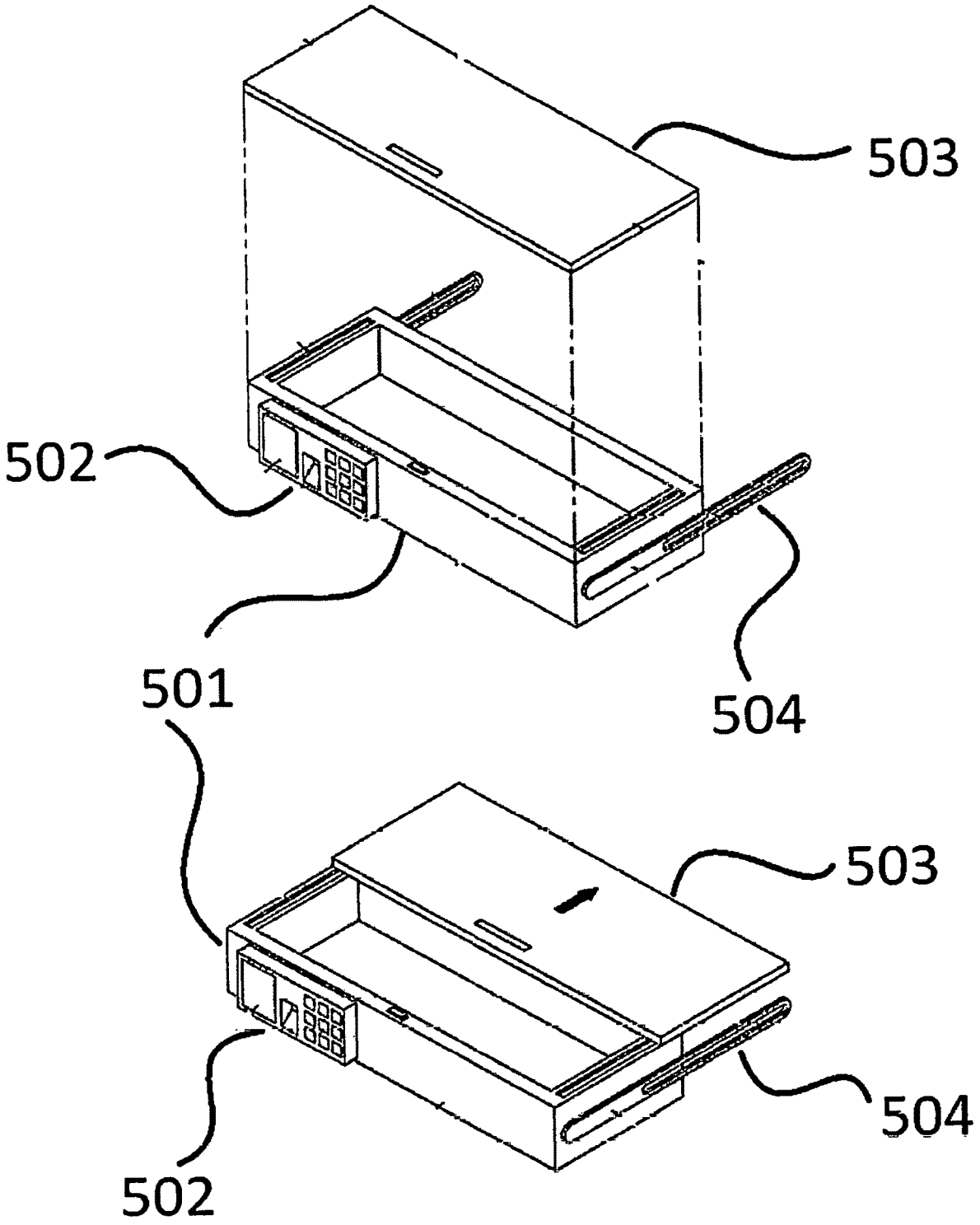
FIG. 5 illustrates a system including one embodiment of the present invention.

FIG. 5 depicts 2 oblique views from the top of the drawer 501 that is part of an embodiment of the present invention. It includes a storage box drawer 501, a locking mechanism 502, a movable support plate 503 on the top of the drawer 501, and a sliding mechanism 504 by which the drawer 501 comes out of the chair is displayed.

The movable support plate 503 is connected to the drawer 501 by the sliding mechanism 504 on top of the drawer 501. The lower surface of the movable support plate 503 is opened to open and close the open top of the drawer 501.

Figure 6:
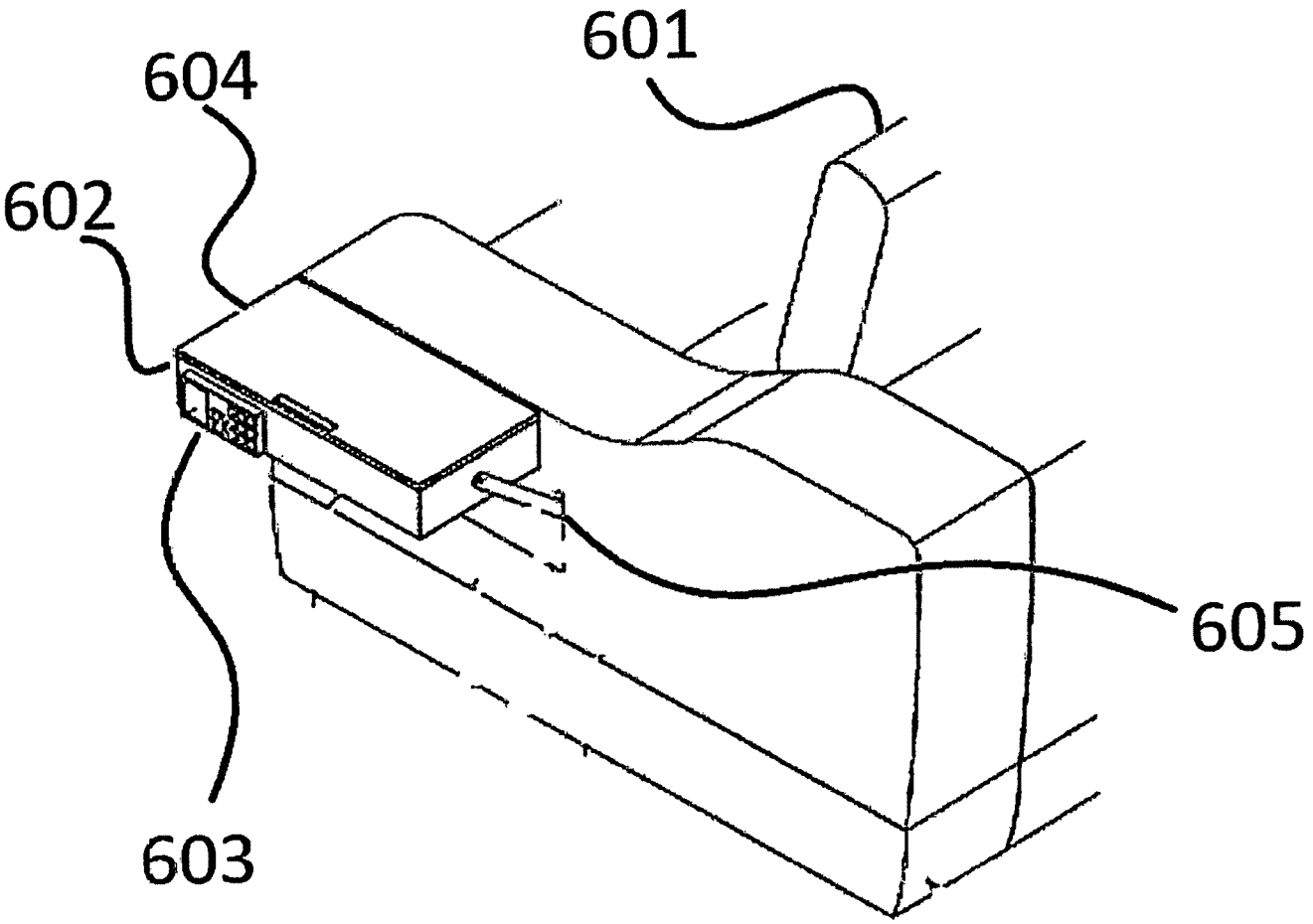
FIG. 6 illustrates a system including one embodiment of the present invention.

FIG. 6 depicts an oblique view of the left part of the chair with an embodiment of the present invention. It includes a chair 601, and a drawer 602 on the left side of the armrest of the chair, wherein the drawer is shown as it would be if it were removed from the chair. In this embodiment, the locking mechanism 603 is on the left side of the drawer. Additionally, the sliding mechanism 604 by which the drawer comes out of the chair is displayed. This embodiment also includes a stick 605, which can be pulled so as to push the drawer out of the seat, after which the drawer can be opened. Furthermore, the sliding mechanism 604 and/or the stick 605 move the drawer 602 upwards to the top of the armrest and attaches to the side as high as the armrest.

Figure 7:
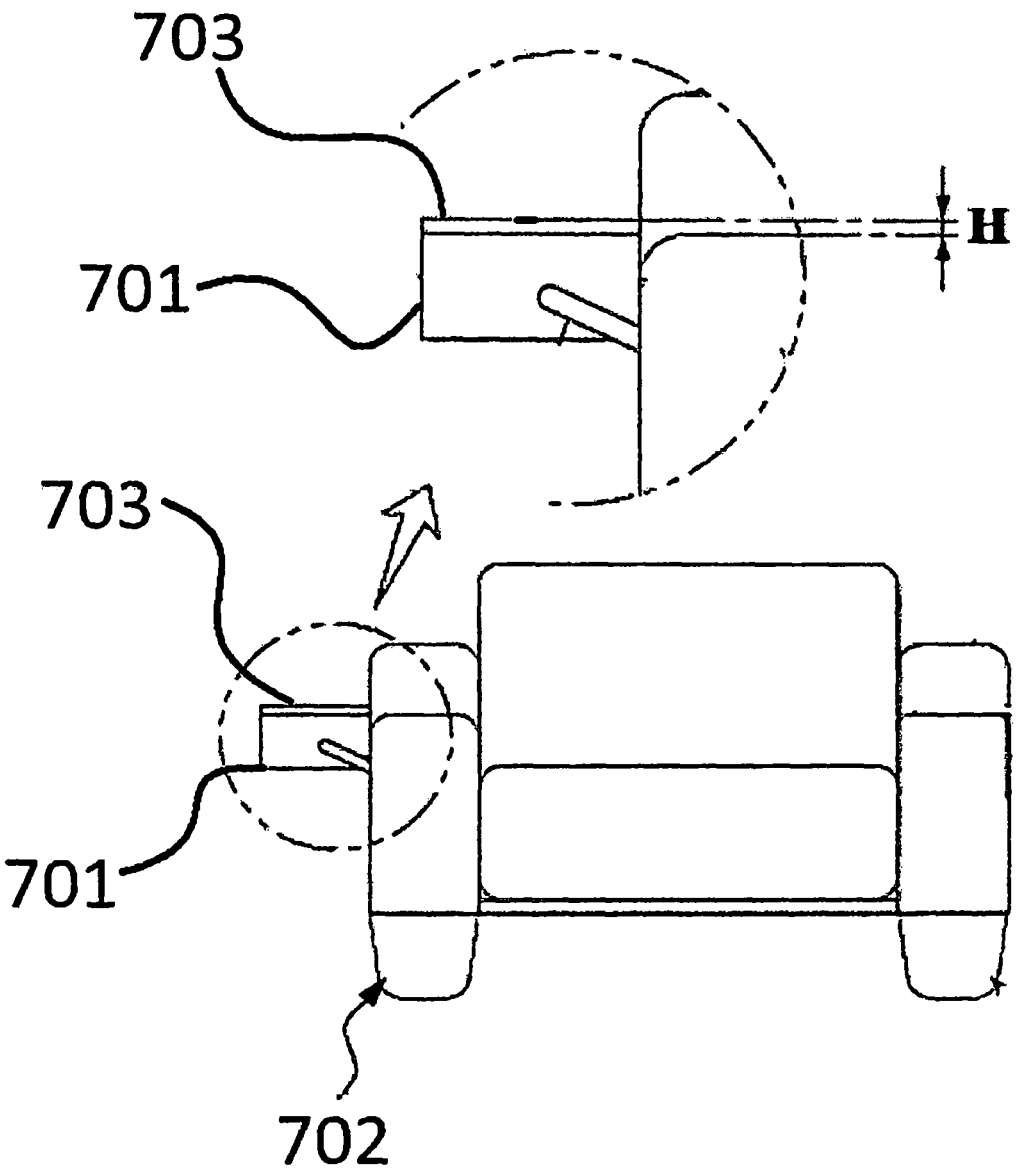
FIG. 7 illustrates a system including one embodiment of the present invention.

FIG. 7 depicts a view of the chair and a zoomed in portion with an embodiment of the present invention.

The support plate 703 is fixed to the drawer 701 by the fixing protrusion of the drawer 701.

The drawer 701 is easily inserted into the upper portion of the armrest portion 10'

The lower surface of the support plate 703 is opened to open and close the open top of the drawer 701.

The top of the drawer 701 is arranged higher than the upper surface of the armrest portion 702 so as to be positioned at a predetermined height H.

The drawer 701 can be attached to the armrest portion 702.

The above descriptions are merely preferred examples of the present invention, and are limited to this invention. Any modifications, equivalent replacements and improvements made within the spirit and principle of the present invention should be included within the scope of protecting this invention.

What is claimed is:

1. A system for easy access on a chair, comprising a drawer on one side of the chair, wherein the drawer can be reached while the person is sitting in the chair;

wherein the drawer includes a locking mechanism to protect the contents of the drawer;

wherein there is a cover over the drawer, and the cover opens sideways;

wherein the drawer with a cover moves completely outward and moves upwards to a top of the armrest;

wherein the drawer with a cover is attachable and detachable from the top of the armrest;

wherein the drawer with a cover is attachable to the armrest at a position lower than the top of the armrest;

wherein a movable support plate is connected to the drawer by a sliding mechanism on top of the drawer;

wherein a lower surface of the movable support plate can be opened to open and close the drawer;

wherein the locking mechanism is either an electronic locking mechanism or a biometric identification mechanism; and wherein another drawer is on another side of the chair.

* * * * *